US010816223B2

(12) United States Patent
Staniforth

(10) Patent No.: US 10,816,223 B2
(45) Date of Patent: Oct. 27, 2020

(54) AUTOMATED TEMPERATURE CONTROL OF HEATING RADIATORS

(71) Applicant: Andrew Brian Staniforth, New York, NY (US)

(72) Inventor: Andrew Brian Staniforth, New York, NY (US)

(73) Assignee: Therm Controls Incorporated, New York, NY (US)

( * ) Notice: Subject to any disclaimer, the term of this patent is extended or adjusted under 35 U.S.C. 154(b) by 334 days.

(21) Appl. No.: 15/660,891

(22) Filed: Jul. 26, 2017

(65) Prior Publication Data

US 2019/0032927 A1 Jan. 31, 2019

(51) Int. Cl.

| | |
|---|---|
| ***F24D 19/10*** | (2006.01) |
| ***F24D 1/02*** | (2006.01) |
| ***F24D 19/08*** | (2006.01) |

(52) U.S. Cl.

CPC ..... *F24D 19/1003* (2013.01); *F24D 1/02* (2013.01); *F24D 19/081* (2013.01)

(58) Field of Classification Search

CPC ..... F24D 19/1003; G05D 23/1934
See application file for complete search history.

(56) References Cited

U.S. PATENT DOCUMENTS

| | | | | |
|---|---|---|---|---|
| 1,490,940 | A | 4/1924 | Russell | |
| 2,338,495 | A | 1/1944 | Davies | |
| 2,368,712 | A | 2/1945 | Jehle et al. | |
| 3,318,647 | A * | 5/1967 | Bishop | F24D 19/04 312/317.1 |
| 3,963,177 | A | 6/1976 | Frank | |
| 4,147,302 | A | 4/1979 | Gray | |
| 4,750,546 | A | 6/1988 | Godbout et al. | |
| 4,765,537 | A | 8/1988 | Donovan | |
| 5,735,456 | A | 4/1998 | Marin et al. | |
| 7,957,839 | B2 | 6/2011 | Takach et al. | |
| 9,046,896 | B1 * | 6/2015 | Brunelle | G05D 23/1934 |
| 9,418,802 | B2 | 8/2016 | Romano et al. | |
| 10,006,642 | B2 * | 6/2018 | Gluck | F22B 1/00 |
| 10,041,689 | B2 | 8/2018 | Kymissis et al. | |
| 2005/0016592 | A1 * | 1/2005 | Jeromson | F16K 3/08 137/487.5 |

(Continued)

OTHER PUBLICATIONS

Wikipedia, "Wikipedia is not a reliable source", 2019, https://en.wikipedia.org/wiki/Wikipedia:Wikipedia_is_not_a_reliable_source (Year: 2019).*

*Primary Examiner* — Avinash A Savani
*Assistant Examiner* — Deepak A Deean
(74) *Attorney, Agent, or Firm* — Myers Wolin, LLC

(57) ABSTRACT

Embodiments are disclosed of a radiator temperature control apparatus for controlling the heat output of a radiator. The radiator temperature control apparatus may include an airtight enclosure around the air outlet of the radiator air vent, an adjustable opening in the airtight enclosure controlled by an actuator, and a controller connected to the actuator. In operation, the controller can be configured to open the adjustable opening in the airtight enclosure allowing air in the radiator to be expelled through the adjustable opening, thereby allowing steam to enter the radiator, and heat the room. The controller can be configured to close the adjustable opening, stopping air from being expelled from the radiator, thereby stopping additional steam from entering the radiator.

7 Claims, 8 Drawing Sheets

(56) References Cited

U.S. PATENT DOCUMENTS

| | | | | |
|---|---|---|---|---|
| 2010/0045470 | A1* | 2/2010 | Araiza | F24D 1/00 340/603 |
| 2011/0127343 | A1* | 6/2011 | Rimmer | F24D 1/00 237/9 R |
| 2014/0252101 | A1 | 9/2014 | Kiouzellis | |
| 2015/0167996 | A1 | 6/2015 | Fadell et al. | |
| 2015/0323200 | A1* | 11/2015 | Gluck | F22B 1/00 237/9 R |
| 2016/0290737 | A1 | 10/2016 | Cox et al. | |
| 2018/0180302 | A1 | 6/2018 | Gabriel et al. | |
| 2018/0181150 | A1* | 6/2018 | Zuluaga | G05D 23/1931 |

* cited by examiner

AUTOMATED TEMPERATURE CONTROL OF HEATING RADIATORS

BACKGROUND

The present invention relates to the automation, monitoring, and control of pre-existing heating systems. As is known in the art, control systems for Heating, Ventilation, and Air Conditioning (HVAC) systems have been evolving—from simple mechanical thermostats to wirelessly controlled "smart" devices. This evolution has allowed for home owners, landlords, and tenants to have greater control of their energy usage and better customize and control the comfort of their spaces.

These new "smart" devices typically replace an older iteration of a similar product (ex. a "smart" thermostat replaces a mechanical thermostat). These new devices are also typically hard wired or plumbed into existing HVAC systems, and in many cases, require advanced skill (ex. trained electrician/licensed plumber) to install the technology properly. However, the technology is advancing at each iteration of these products to allow for easier installation and more ubiquitous adoption.

Modern central heating systems, in general, typically fall into three categories: forced hot air, hot water, and steam. Typically, forced hot air systems rely on a central furnace and a system of ducts to heat and deliver the warmed air. Typically, hot water systems rely on a central boiler and a system of pipes and radiators and/or convectors to deliver hot water; that hot water emits heat warming the space. Typically, steam systems also rely on a central boiler and a system of pipes and radiators and/or convectors to deliver steam; that steam emits heat warming the space.

Steam systems have two typical configurations: two pipe, and one pipe.

In a two-pipe system, steam is delivered to the radiators through pipes. Each radiator has two pipes connected to it. One pipe delivers the hot steam from the boiler. As the heat in the steam is transferred to the room, the water vapor condenses. That condensed water flows through the second pipe connected to the radiator and flows back to the boiler.

In a one-pipe system, steam is delivered to the radiators through pipes. Each radiator has only one pipe connected to it. As the heat in the steam is transferred to the room, the water vapor condenses. That condensed water flows through the same pipe system back to the boiler.

Air is present within a one-pipe steam system. As steam is created in the boiler and flows to the radiators, the air in the system is pushed out through a series of vents. The vents are calibrated to allow the release of air, but trap the steam within the radiator. These vents allow the expulsion of the air in the system, which is required to allow the steam to flow and fill the radiator.

The vents are located on each radiator and also on locations throughout the main pipe system. If the vent is forced closed or blocked, the steam will not flow, and the radiator will not heat the room.

One pipe steam systems are typically controlled by one thermostat or a series of thermostats (central thermostat control). In some configurations when a series of thermostats is used in different rooms and/or on different floors, the thermostats may deliver the average temperature of the building to the boiler control. The thermostat(s) control the production of steam in the boiler. When steam is produced in the boiler, it flows freely through the pipe system to the radiators.

Over- and under-heating is common in one pipe steam systems. The thermostat delivers only one area's temperature to the boiler, which becomes the only area influencing the activation of the boiler and the flow of steam. Multiple factors throughout a building, such as doors and windows or occupants and use, cause the temperature in a building vary greatly from one room/floor to another, making a singular thermostat or a series of thermostats imprecise at controlling the heating of a building.

For example, a room with many energy inefficient windows which also contains the one thermostat for the building may activate the boiler more frequently because the inefficient windows cause the temperature in the space to be lower. In the same building, a second room, with energy efficient windows, will have its radiator release heat based on the frequent activation of the thermostat in the first room, causing overheating.

Proper balancing of a system may mitigate some of the temperature disparities throughout the building. This balancing calibrates the system taking into account the differences among rooms/floors to deliver steam heat in a more balanced way. While this may address some of the inefficiencies in the distribution of the heat, the environmental factors within a building often change (such as an open window). Each change would require a new balancing exercise. Additionally, steam systems are extremely prevalent in large pre-war multifamily buildings. The balancing of these buildings can be easily disrupted by one tenant opening a window, or another tenant using the oven, rendering the system balancing ineffective.

Multifamily landlords are typically required by law to deliver a minimum level of heating to their tenants. In order to deliver the minimum level of heating to all tenants, the landlord will often deliver an excess of heat to the overall system in order to meet the minimum level of heating in the coldest unit (ex. a unit on the bottom floor with many inefficient windows and a drafty front door). This causes an overheating of the other units because the system is calibrated to deliver heat based on the coldest unit. Many tenants in the overheated units will open windows to regulate the temperature of their units causing a significant waste of the heat.

Control devices which provide localized control of each radiator exist. Specifically, these devices are Thermostatic Radiator Values (TRV). These TRVs use room temperature to actuate the radiator vent. The actuation of the vent allows for control of the release of air, thus limiting the flow of steam and thus controlling the heat of the room. These TRVs require the replacement of the existing radiator vent. Modifying a radiator may be intimidating to the average home owner or tenant, and further many tenants would be prohibited from making these modifications to a rental unit.

Therefore, a need exists for a control system and mechanism which allows for control of individual radiators without modification or replacement to components of the existing heating system.

SUMMARY OF THE INVENTION

The present invention is an apparatus that allows users to remotely and/or programmatically control heating radiators. The apparatus comprises an airtight enclosure around the air outlet of a radiator air vent, an adjustable opening in said airtight enclosure, an actuator configured to open and close said adjustable opening, and a controller coupled to the actuator.

The apparatus encloses the radiator air vent such that the air outlet of the radiator air vent is sealed within the airtight enclosure of the apparatus. The controller controls the actuator coupled to the adjustable opening in the airtight enclosure. The adjustable opening regulates the flow of air out the airtight enclosure. For the radiator to fill with steam and heat a space, the existing air within the radiator must be expelled through the radiator air vent. The present invention fully encloses the air outlet of the radiator air vent and thus controls the air being expelled from the radiator. To allow steam to enter the radiator and heat the room, the controller, using the actuator, opens the adjustable opening. To stop steam from entering the radiator, the controller, using the actuator, closes the adjustable opening.

DETAILED DESCRIPTION OF THE INVENTION

Various embodiments are disclosed herein of novel apparatus and methods for controlling the heat output of a radiator. Some but not all embodiments are disclosed in the text of this section and the accompanying drawings. The following description and drawings are illustrative of the present invention and should not be viewed as limiting the scope of the present invention. Various additional embodiments not described herein may include different configurations, materials, and/or combinations of the described embodiments and fall within the scope of the present invention. These embodiments are provided so that this disclosure will satisfy legal requirements.

The present invention is an apparatus which allows for the remote and/or programmatic regulation of the flow of air out of an air outlet of a radiator air vent, thus regulating the flow of steam into a radiator, and therefore controlling the heating of a room. The apparatus encloses the air outlet of a radiator air vent and does not replace the radiator air vent, thus eliminating the need for modifications to the heating system.

Figure 1:
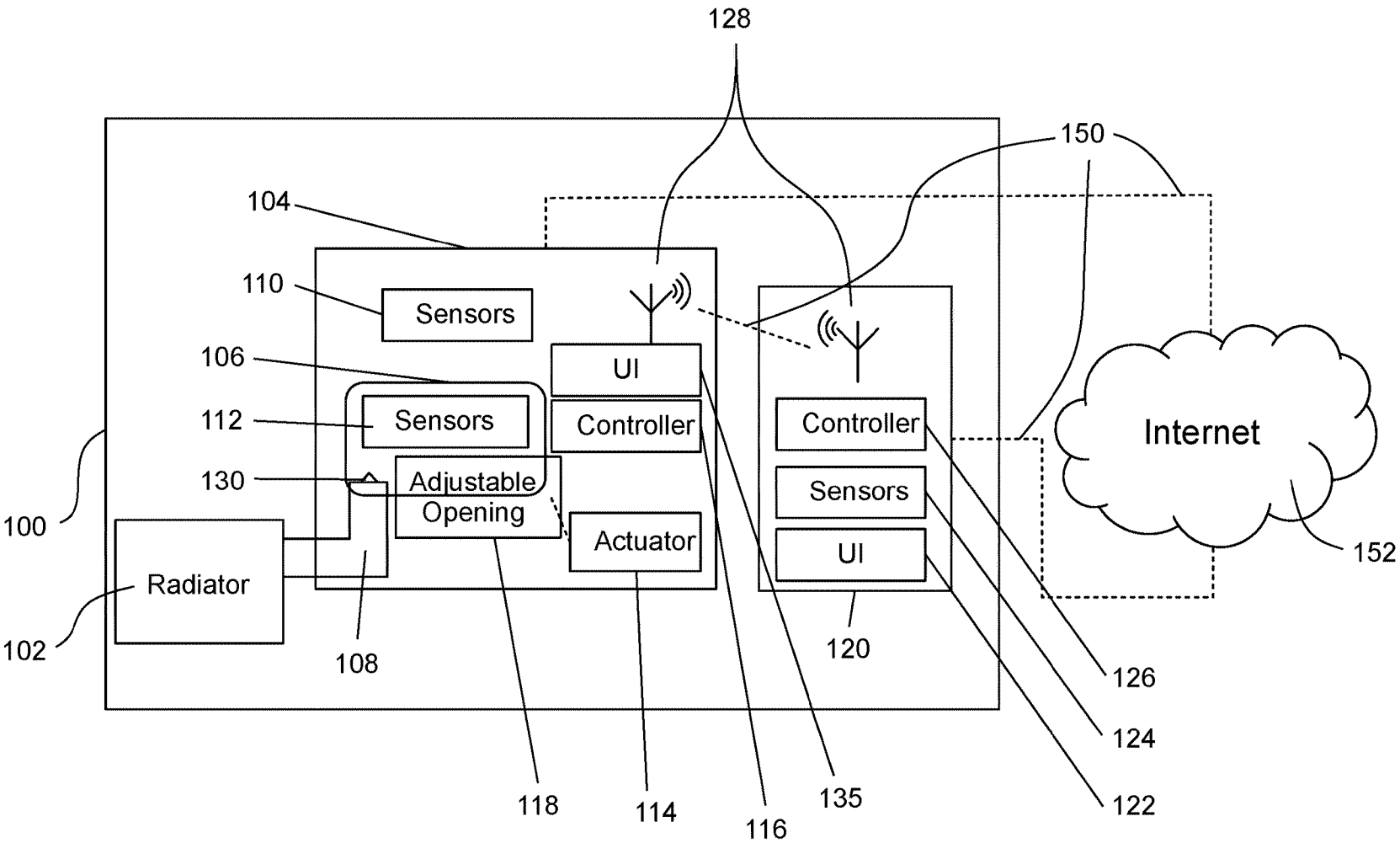
FIG. 1 is a schematic depiction of an embodiment of a radiator temperature control apparatus.

FIG. 1 is a diagrammatic example of a radiator temperature control apparatus 104 used to control the heat in room 100 emitted from a radiator 102. In embodiments, a one-pipe steam radiator 102 has an air vent 108, and the air vent has an air outlet 130. In embodiments, the radiator temperature control apparatus 104 contains an airtight enclosure 106 around the air outlet 130 the air vent 108, an actuator 114, a controller 116, and adjustable opening 118. The actuator 114 may be coupled to the adjustable opening 118. The controller 116 may be coupled to the actuator 114.

In embodiments, an actuator 114 within the radiator temperature control apparatus 104 is provided. The actuator 114 controls the adjustable opening 118 regulating the release of air within the airtight enclosure 106. In embodiments, the adjustable opening 118 maintains the airtight seal of the airtight enclosure 106 around the air outlet 130 when closed, and when open, the airtight seal of the airtight enclosure 106 is broken and the air within the airtight enclosure 106 can escape through the adjustable opening 118.

In embodiments, the radiator temperature control apparatus includes a controller 116 to handle the logic required to control the actuator 114. Additionally, the controller may handle scheduling and to run calculations and/or algorithms used to better customize and control the regulation of heat within the room.

In some embodiments, the airtight enclosure 106 may enclose part or all of the radiator air vent 108. In some embodiments, the airtight enclosure 106 may enclose only the air outlet 130. In some embodiments, the airtight enclosure 106 is created using closed cell foam to provide an airtight seal around the air outlet 130 and/or air vent 108. In some embodiments, an elastic sleeve is rolled over the air vent 108 to create the airtight enclosure 106 around the air outlet 130.

For radiator 102 to fill with steam and release heat, the air contained in the radiator needs to be expelled through the air outlet 130 of air vent 108. If the air outlet 130 of the air vent 108 is enclosed by an airtight enclosure 106, the air in the radiator 102 cannot be expelled, and steam will not flow into the radiator 102, and the radiator will not heat the room 100. If the actuator 114 opens the adjustable opening 118, the airtight seal is broken. When the adjustable opening 118 is open, air in the radiator 102 can be expelled through the air outlet 130 and then flow through the adjustable opening 118; this allows steam to flow into the radiator 102, thus heating the room 100.

In some embodiments, the present invention may include one or more wireless communication interfaces 128. Various embodiments of wireless communication interfaces may be provided including but not limited to Wi-Fi, Bluetooth, Bluetooth Low energy, Z-wave, and/or Zigbee. The radiator temperature control apparatus 104 can also receive control information from remote servers and/or devices through a wireless communication channel 150 and/or through the internet 152. The wireless communication may allow for remote and/or scheduled control of the radiator temperature control apparatus 104.

In some embodiments, the wireless communication interface 128 allows for remote calculations and/or algorithms to be performed based on information sent from the radiator temperature control apparatus 104 to a remote server and/or device connected to the internet 152. These remote algorithms and/or calculation are performed to better customize and control the regulation of heat within the room 100. These remote algorithms and/or calculations may directly control the radiator temperature control apparatus 104 and/or may update the configuration and/or control logic on the controller 116.

In some embodiments, the radiator temperature control apparatus 104 may include one or more environmental sensors 110 and/or 112. Environmental sensors 110 are outside of the airtight enclosure and measure the ambient environment; environmental sensors 112 are within and/or are configured to measure the environment within the airtight enclosure 106. These sensors may include temperature sensors, pressure sensors, and/or air flow sensors. The environmental sensors may be coupled with the controller 118 via communication channel. In some embodiments, the environmental sensors may be connected to the internet 152 and/or remote devices and/or servers using the wireless communication interface 128 via a wireless communication channel 150.

In some embodiments, environmental sensors 112 include air flow sensors. The air flow sensors are coupled to the air outlet 130 of the air vent 108 and/or airtight enclosure 106 to determine if air is flowing from the air outlet 130.

In some embodiments, environmental sensors 112 include pressure sensors. The pressure sensors may be located within enclosure 106. In operation, with the adjustable opening 118 closed, as air flows from the air outlet 130 of the air vent 108, the pressure inside enclosure 106 will change; this pressure change will be detected by the pressure sensor 112.

In some embodiments, environmental sensors 110 and/or 112 include temperature sensors. Temperature sensors 110 are used to determine the ambient temperature of the room 100 and temperature sensors 112 are used to determine the temperature within the airtight enclosure 106.

In some embodiments, in operation, if the environmental sensors 110 indicate that the room 100 has a temperature below a given set point, the controller 116 will open the adjustable opening 118 by controlling the actuator 114. When the adjustable opening 118 is open, air can flow from the radiator 102 out of the air outlet 130 of the air vent 108, allowing steam to fill the radiator 102.

In some embodiments, the wireless communication interface 128 allows the radiator temperature control apparatus 104 to send information from sensors 110 and/or 112 and the status of actuator 114 to remote servers and/or devices connected to the internet 152 and/or through a wireless communication channel 150.

In some embodiments, the radiator temperature control apparatus 104 provides a local user interface 130. This may include buttons for input to alter set points and/or other configurations on the controller 116. Additionally, this may include a display to show information on the current configuration as well as information from the environmental sensors.

In some embodiments, the radiator temperature control apparatus 104 with a wireless communication interface 128 can connect to remote servers and/or devices through the internet 152 and/or via wireless communication channel 150. This connectivity allows the radiator temperature control apparatus to be controlled by websites, web applications, and mobile applications.

In some embodiments, a remote sensing and control unit 120 is provided. In some embodiments, the remote sensing and control unit 120 contains a temperature sensor 124 to relay the ambient room temperature to the remote sensing and control unit controller 126, the radiator temperature control apparatus controller 116, and/or a remote server and/or device connected to the internet 152 and/or via a wireless communication channel 150. In some embodiments, the remote sensing and control unit 120 contains a wireless communication interface 128. In some embodiments, the remote sensing and control unit 120 contains a controller 126 to handle scheduling and to run calculations and/or algorithms used to better customize and control the regulation of heat within the room 100.

In some embodiments, the remote sensing and control unit 120 acts as a bridge between the internet 152 and the radiator temperature control apparatus 104. The remote sensing and control unit may have multiple wireless communication interfaces 128. In some embodiments, one wireless communication interface 128 connects to the internet 152 and another wireless communication interface 128 connects to the radiator temperature control apparatus 104. The controller 126 of the remote sensing and control unit 120 may relay the information between the two wireless communication interfaces 128.

In some embodiments, the remote sensing and control unit 120 provides for a local user interface 122. This may include buttons for input to alter set points and other configurations in the controller 126 and/or controller 116. Additionally, this may include a display to show information on the current configuration as well as information from the environmental sensors from the radiator temperature control apparatus 104 and/or the remote sensing and control unit 120.

Figure 2:
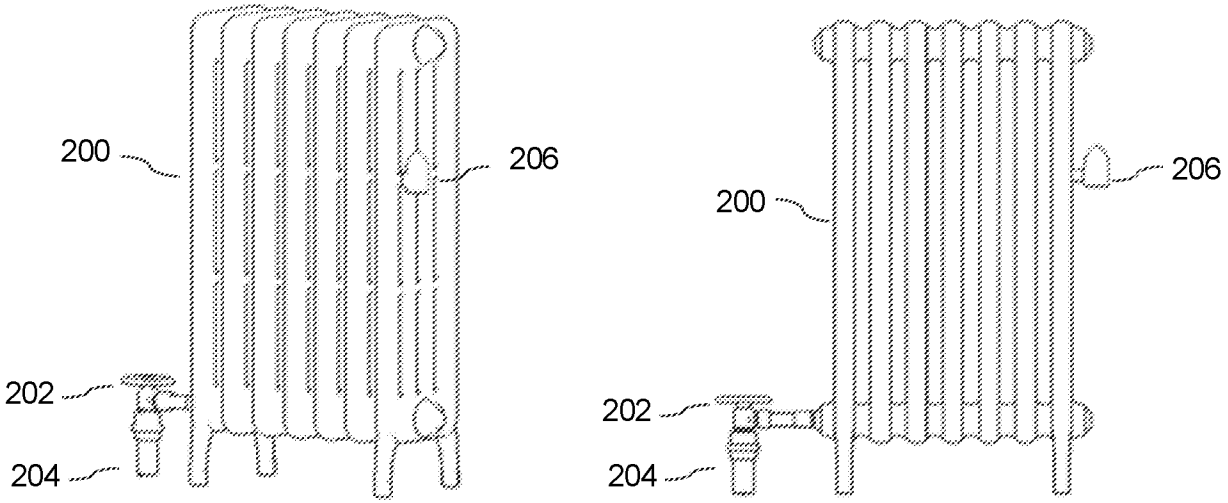
FIG. 2 is a diagram illustrating a one pipe steam radiator.

FIG. 2 is a diagram illustrating an existing one pipe steam radiator 200. The one pipe steam radiator 200 has a radiator valve 202, a steam inlet 204, and an air vent 206. In some embodiments, the radiator temperature control apparatus can control the heat released from radiator 200.

Figure 3:
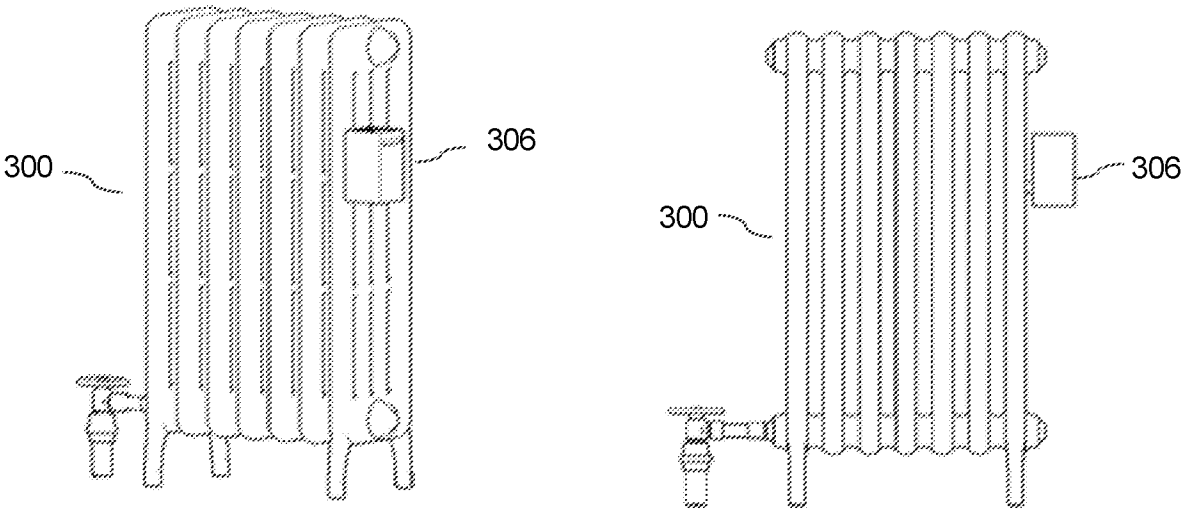
FIG. 3 is a diagram illustrating a one pipe steam radiator with an embodiment of a radiator temperature control apparatus.

FIG. 3 is a diagram illustrating an existing one pipe steam radiator 300 with a radiator temperature control apparatus 306. In some embodiments, radiator temperature control apparatus 306 is affixed around the radiator air vent 206.

Figure 4:
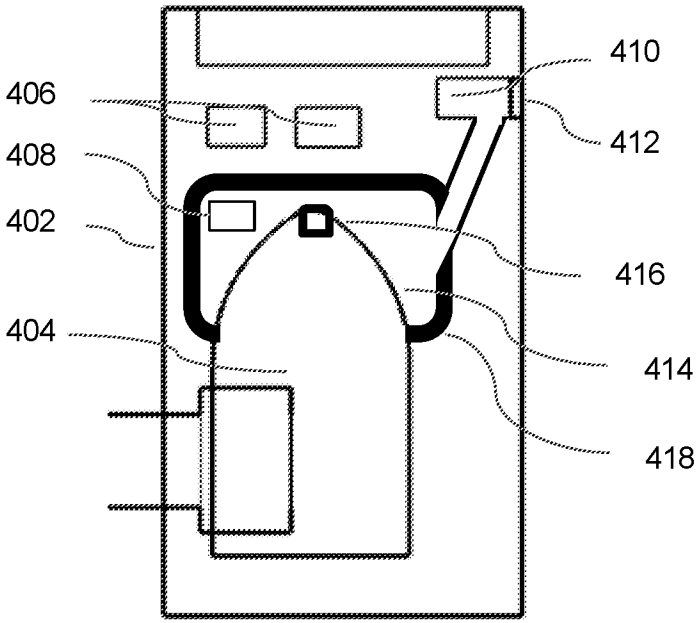
FIG. 4 is a diagram illustrating an embodiment of a radiator temperature control apparatus.

FIG. 4 is a diagram illustrating one embodiment of the radiator temperature control apparatus 402. In some embodiments, the airtight enclosure 414 is formed by sealing the portion of the radiator air vent 404 which contains the air outlet 416. In some embodiments the seal 418 may be created with closed cell foam. In some embodiments, there may be environmental sensors 408 within the airtight enclosure 414 configured to measure temperature, pressure, and/or air flow. In some embodiments, there may be environmental sensors 406 outside of the airtight enclosure 414 configured to measure the ambient environment. In some embodiments, the airtight enclosure 414 is extended to connect to the adjustable opening 412. The adjustable opening 412 is controlled by the actuator 410.

Figure 5:
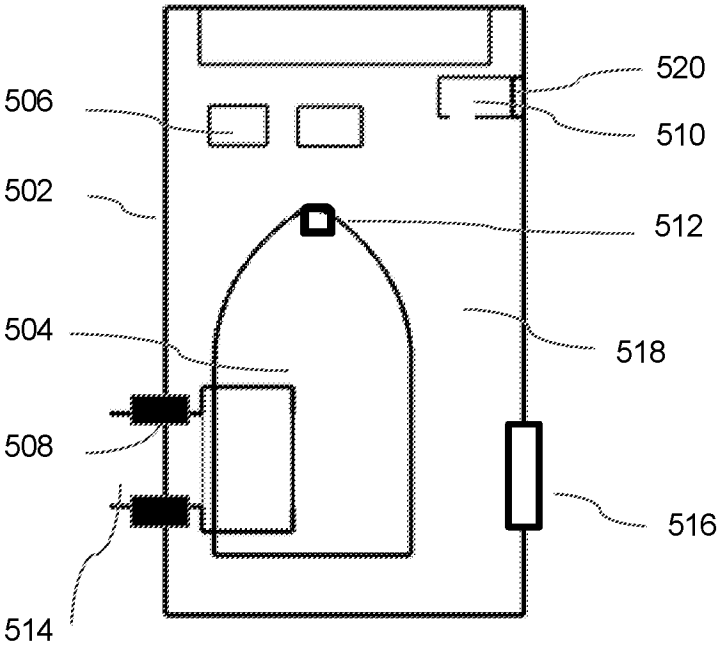
FIG. 5 is a diagram illustrating an embodiment of a radiator temperature control apparatus.

FIG. 5 is a diagram illustrating one embodiment of the radiator temperature control apparatus 502. In some embodiments, the airtight enclosure is created by sealing the neck 514 of the air vent 504. In some embodiments the seal 508 may be created with closed cell foam. The space within the radiator temperature control apparatus 502 becomes the airtight enclosure 518. In some embodiments there may be environmental sensors 506 within the airtight enclosure 518 configured to measure temperature, pressure, and/or air flow. In some embodiments, there may be environmental sensors 516 outside of the airtight enclosure configured to measure the ambient environment. In some embodiments, the adjustable opening 520 is controlled by the actuator 510.

Figure 6:
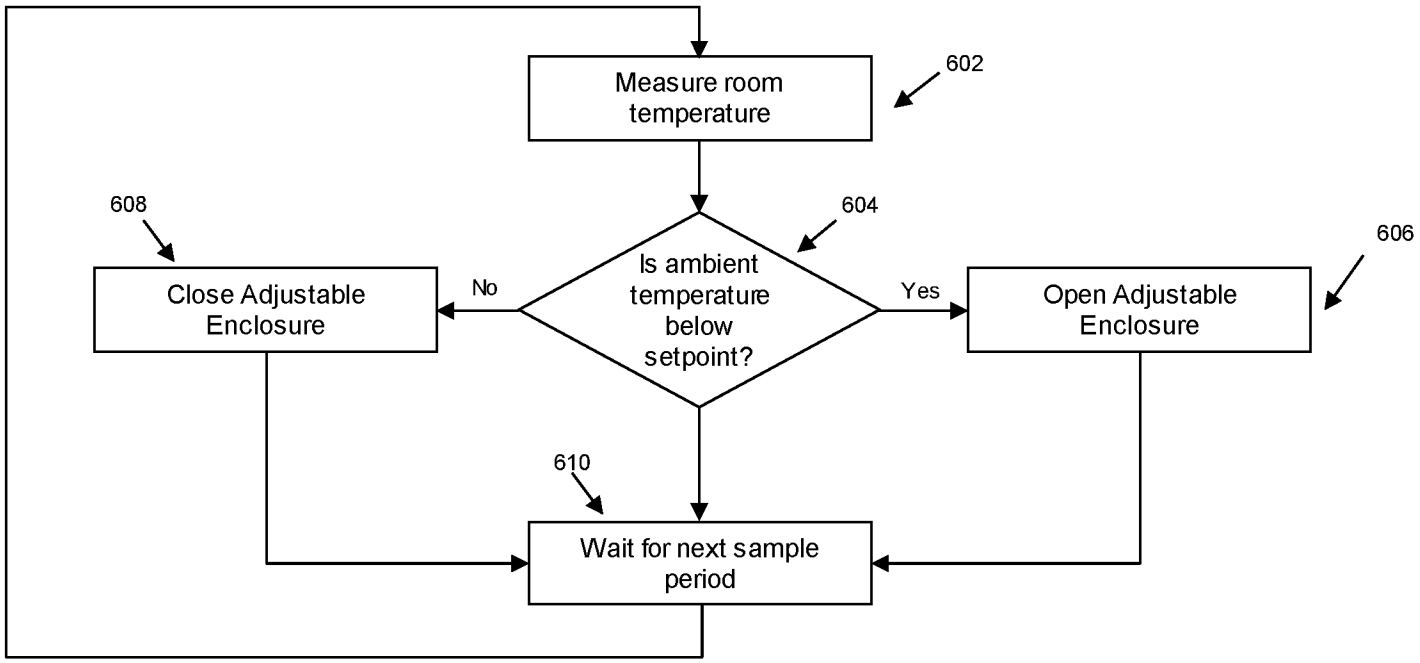
FIG. 6 is a flow diagram illustrating an example of the operation of a radiator temperature control apparatus.

FIG. 6 is a flow diagram illustrating an example of operating a radiator temperature control apparatus. At 602 a controller measures ambient temperature of a room. At 604, the controller compares a desired set point to the measured ambient temperature. In some embodiments, the desired set point is preconfigured on the controller. In other embodiments, the user can program a desired set point in the controller.

If the ambient temperature is below the desired set point, at 604 the radiator temperature control apparatus can open the adjustable opening in the airtight enclosure around the air outlet of radiator air vent 606, such that during a heating cycle, the radiator will expel air and fill with steam. At 610, the controller can wait for the next sample period and then proceed to 602.

If the ambient temperature is not below the desired set point, at 604 the radiator temperature control apparatus can close the adjustable opening in the enclosure around the radiator air vent 608, such that during a heating cycle, the radiator will not expel air and will not fill with steam. At 610, the controller can wait for the next sample period and then proceed to 602.

Figure 7:
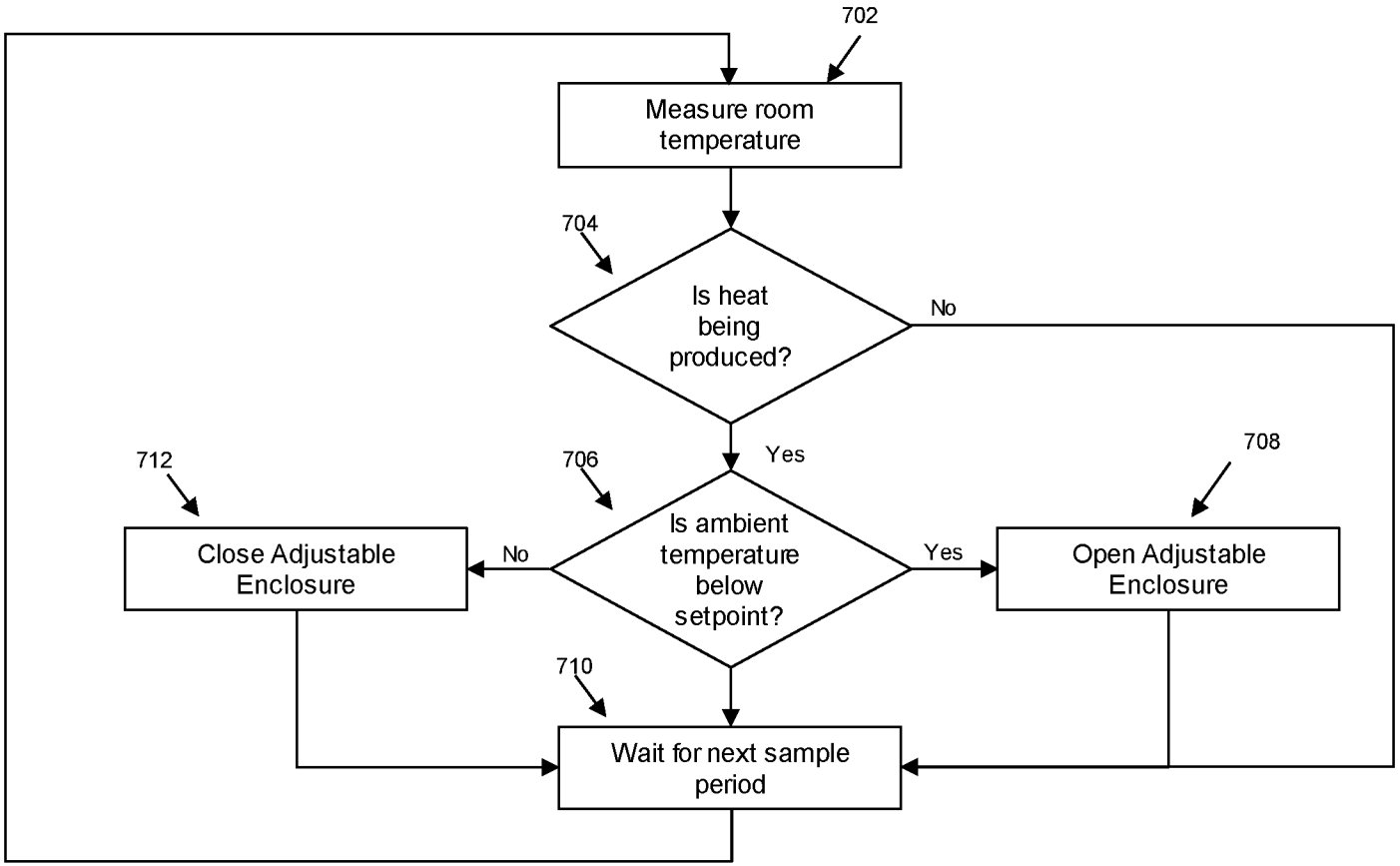
FIG. 7 is a flow diagram illustrating an example of the operation of a radiator temperature control apparatus.

FIG. 7 is a flow diagram illustrating an example of operating a radiator temperature control apparatus. In this example, the operating of a radiator temperature control apparatus checks to see if heat is being produced before acting on the adjustable opening. At 702 a controller measures ambient temperature of a room. At 704 a controller determines if heat is being produced. In some embodiments, the air flow and/or pressure sensors are used to detect if air is trying to and/or is flowing from the air outlet of the radiator air vent. If heat is not being produced, the controller can wait for the next sample period 710 and then proceed to 702. If heat is being produced, at 706 the controller compares a desired set point to the measured ambient temperature. In some embodiments, the desired set point is preconfigured on the controller. In other embodiments, the user can program a desired set point in the controller.

If the ambient temperature is below the desired set point, at 706 the radiator temperature control apparatus can open the adjustable opening in the airtight enclosure around the air outlet of the radiator air vent 708, such that during a heating cycle, the radiator will expel air and fill with steam. At 710, the controller can wait for the next sample period and then proceed to 702.

If the ambient temperature is not below the desired set point, at 706 the radiator temperature control apparatus can close the adjustable opening in the airtight enclosure around the air outlet of the radiator air vent 712, such that during a heating cycle, the radiator will not expel air and will not fill with steam. At 710, the controller can wait for the next sample period and then proceed to 702.

Figure 8:
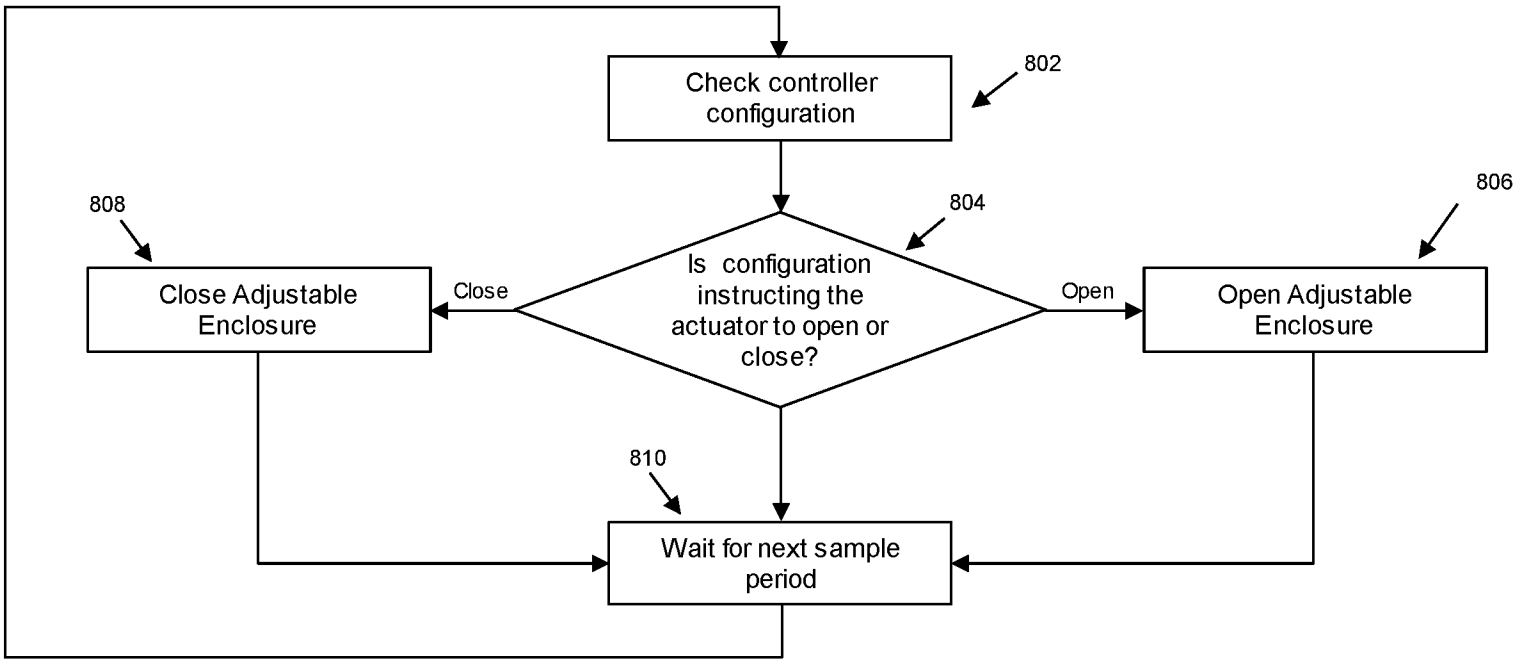
FIG. 8 is a flow diagram illustrating an example of the operation of a radiator temperature control apparatus.

FIG. 8 is a flow diagram illustrating an example of operating a radiator temperature control apparatus. At 802 the controller checks its configuration to see if the configuration is instructing the adjustable opening to open or close. At 804, if the controller is instructing the adjustable opening to open, the radiator temperature control apparatus can open the adjustable opening in the airtight enclosure around the air outlet of the radiator air vent 806, such that during a heating cycle, the radiator will expel air and fill with steam. At 810, the controller can wait for the next sample period and then proceed to 802. At 804, if the controller is instructing the adjustable opening to close, the radiator temperature control apparatus can close the adjustable opening in the airtight enclosure around the air outlet of the radiator air vent 808, such that during a heating cycle, the radiator will not expel air and will not fill with steam. At 810, the controller can wait for the next sample period and then proceed to 802. In some embodiments, the controller configuration is set by a user, for example, on a programmable schedule. In alternate embodiments, the controller's configuration is set by a remote server and/or device. That remote server and/or device may use various environmental sensors to determine what settings to include in the controller's configuration, for example using external temperature and/or a remote ambient temperature sensor.

In some embodiments, additional steps can be added to FIG. 6, 7, 8 to check to see if the adjustable opening is already open or closed before proceeding to open or close the adjustable opening. If the adjustable opening is determined to already be in the desired state, the system will not take action on the actuator and wait for the next sample period.

Although the foregoing specification has described specific examples and embodiments of the present invention, it will be readily apparent to those of ordinary skill in the art that other embodiments and examples may exist without departing from the broader spirit and scope of the invention. Said other embodiments and examples are contemplated and intended to be covered by the following claims.

What is claimed is:

1. A method of controlling the heat output of a radiator, the method comprising:

enclosing an air outlet of a radiator air vent with an airtight enclosure;

providing the airtight enclosure with an adjustable opening;

providing one or more air flow sensors within the airtight enclosure, the air flow sensors configured to detect air flow within the airtight enclosure;

opening the adjustable opening to place the radiator into a heating configuration; and closing or occluding the adjustable opening to place the radiator into a non-heating configuration.

2. The method of controlling the heat output of a radiator of claim 1, further comprising:

receiving ambient temperature information from one or more temperature sensors;

wherein the ambient temperature information is compared to a set point such that the radiator is placed into the heating configuration when the ambient temperature is below a first set point and the radiator is placed into a non-heating configuration when the ambient temperature is above a second set point and the air flow sensors detect air flow within the airtight enclosure.

3. The method of controlling the heat output of a radiator of claim 1, further comprising: receiving updates to controller configuration and/or set point from a remote server and/or device.

4. The method of controlling the heat output of a radiator of claim 2, further comprising: transmitting ambient temperature information to a remote server and/or device.

5. A method of controlling the heat output of a radiator, the method comprising:

enclosing an air outlet of a radiator air vent with an airtight enclosure;

providing the airtight enclosure with an adjustable opening;

providing one or more pressure sensors within the airtight enclosure, configured to detect a pressure change within the airtight enclosure;

receiving ambient temperature information from one or more temperature sensors;

opening the adjustable opening to place the radiator into a heating configuration; and closing or occluding the adjustable opening to place the radiator into a non-heating configuration, wherein a determination of when to open the adjustable opening is based in part on the output of the one or more pressure sensors, wherein the ambient temperature information is compared to a set point such that the radiator is placed into the beating configuration when the ambient temperature is below a first set point and the one or more pressure sensors indicate pressure within the airtight enclosed above a threshold pressure.

6. The method of controlling the heat output of a radiator of claim 5, further comprising: receiving updates to a controller configuration and/or set point from a remote server and/or device.

7. The method of controlling the heat output of a radiator of claim 5, further comprising: transmitting ambient temperature information to a remote server and/or device.

* * * * *